US011247111B2

(12) United States Patent
Harvey, Jr. et al.

(10) Patent No.: US 11,247,111 B2
(45) Date of Patent: Feb. 15, 2022

(54) SPORTS BALL THROWING MACHINE LIFT

(71) Applicants: Harry Herbert Harvey, Jr., Las Vegas, NV (US); David Boardman, Las Vegas, NV (US)

(72) Inventors: Harry Herbert Harvey, Jr., Las Vegas, NV (US); David Boardman, Las Vegas, NV (US)

(73) Assignee: Harry Herbert Harvey, Las Vegas, NV (US)

( * ) Notice: Subject to any disclaimer, the term of this patent is extended or adjusted under 35 U.S.C. 154(b) by 0 days.

(21) Appl. No.: 16/877,316

(22) Filed: May 19, 2020

(65) Prior Publication Data

US 2021/0362028 A1 Nov. 25, 2021

(51) Int. Cl.
*A63B 69/00* (2006.01)
*A63B 69/40* (2006.01)

(52) U.S. Cl.
CPC ..... *A63B 69/40* (2013.01); *A63B 2225/093* (2013.01)

(58) Field of Classification Search
CPC ..... A63B 69/40; A63B 2225/093
USPC ..... 473/422, 451, 431; 124/17
See application file for complete search history.

(56) References Cited

U.S. PATENT DOCUMENTS 2,080,958 A * 5/1937 Beasley ..... A63B 69/408 124/7
2,267,163 A * 12/1941 Moser ..... A63B 69/40 124/17
3,521,860 A 7/1970 Zehrung, Jr.
3,599,812 A 8/1971 Hasstedt
3,722,494 A * 3/1973 Slevin ..... A63B 69/408 124/7
4,082,076 A * 4/1978 Perry ..... A63B 69/408 124/34
4,111,179 A * 9/1978 Hashimoto ..... A63F 9/0252 124/17
4,262,648 A * 4/1981 Wegener ..... A63B 69/408 124/32
4,271,813 A * 6/1981 Rowe ..... A63B 69/408 124/34
4,669,703 A 6/1987 Hawkins et al.
4,860,717 A * 8/1989 Powell ..... A63B 69/408 124/7
5,123,643 A * 6/1992 Heilhecker ..... A63B 69/407 124/21
5,249,564 A * 10/1993 Peachey ..... A63B 69/40 124/17
5,261,640 A 11/1993 Yuan
(Continued)

*Primary Examiner* — Mitra Aryanpour
(74) *Attorney, Agent, or Firm* — Lowenstein Sandler LLP

(57) ABSTRACT

A sports ball throwing machine lift (SBTML) includes a first machine upright post and a second machine upright post that are configured to attach to a sports ball throwing machine. The SBTML further comprises a rod connected vertically between the first machine upright post and the second machine upright post. The SBTML further comprises a base, a plurality of wheels attached to a lower surface of the base, and an upright post that extends up from the base. The SBTML further comprises a lifting bar that is pivotably connected to an upper portion of the upright post. The SBTML further comprises a lifting device configured to cause the lifting bar to lift the rod. The lifting device includes a mechanical jack or an electric actuator.

9 Claims, 4 Drawing Sheets

(56) References Cited

U.S. PATENT DOCUMENTS

| | | | | |
|---|---|---|---|---|
| 5,911,214 | A * | 6/1999 | Andrews | A63B 69/408 124/16 |
| 7,392,801 | B2 * | 7/2008 | McCallister | A63B 21/0552 124/17 |
| 7,794,338 | B2 * | 9/2010 | Cherry | A63B 69/40 473/451 |
| 10,603,568 | B2 * | 3/2020 | Palanethra | F41B 3/03 124/7 |
| 2007/0232419 | A1 * | 10/2007 | Kosjer | A63B 69/0002 473/451 |

* cited by examiner

SPORTS BALL THROWING MACHINE LIFT

BRIEF DESCRIPTION OF THE DRAWINGS

Embodiments of the present disclosure are illustrated by way of example, and not by way of limitation, in the figures of the accompanying drawings.

DETAILED DESCRIPTION

Figure 3:
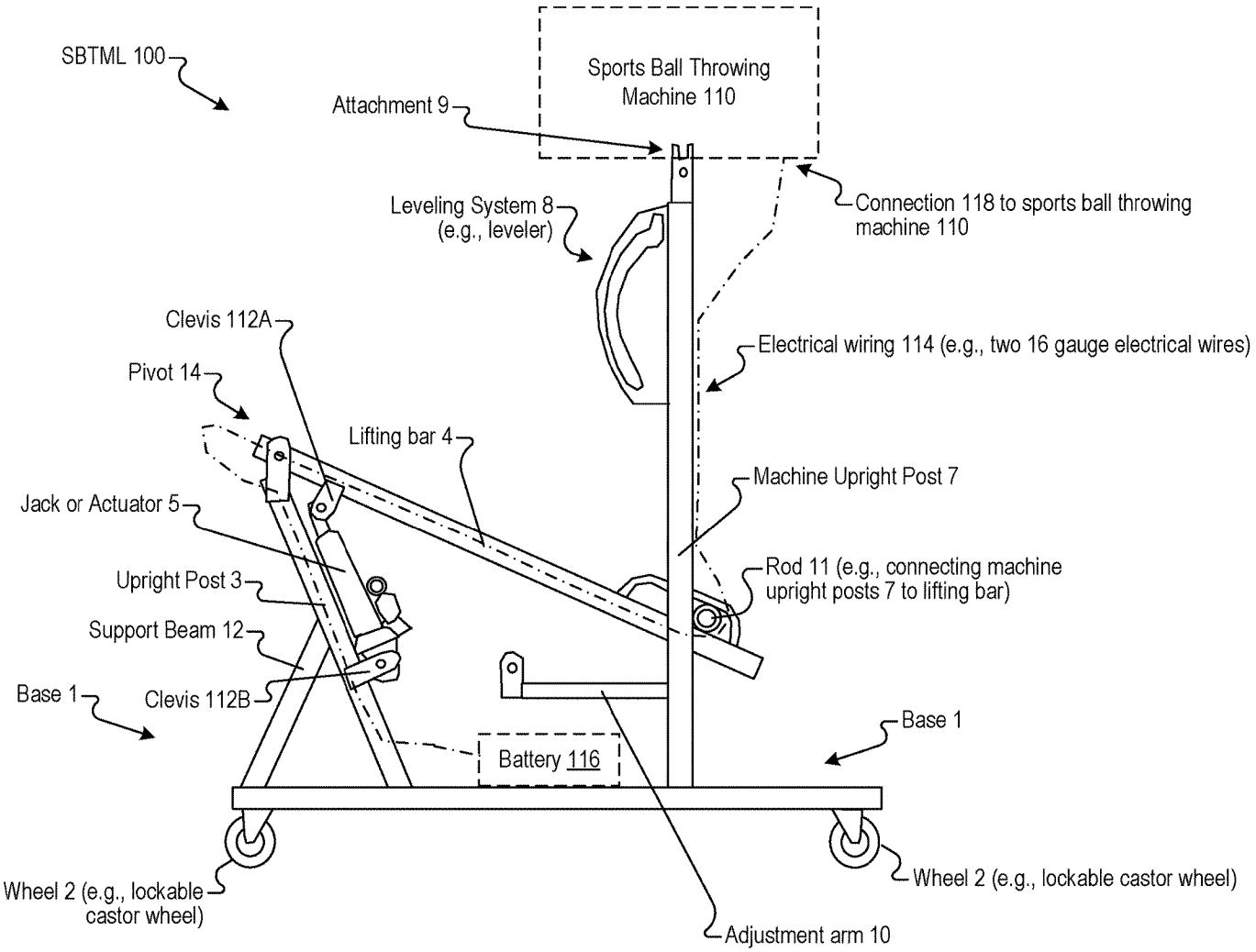
FIG. 3 illustrates a right side view of a SBTML, according to certain embodiments.

A sports ball throwing machine lift (SBTML) can lift a sports ball throwing machine up to over 9 feet in height. The SBTML is configured to simulate balls coming at a user from a higher elevation that is more similar to actual (e.g., real-life) game situations. The SBTML may be equipped with four locking caster wheels. The SBTML has a base which has an upright post that extends up from the base of the SBTML and carries a pivotal lifting bar at top of the upright post. A lifting device (e.g., mechanical jack or an electric actuator) lifts the bar at the top of the upright post. As the bar is lifted higher, the bar pushes a rod which is connected vertically to the two machine upright posts. The sports ball throwing machine is attached to the two machine upright posts. As the machine upright posts elevate, the sports ball throwing machine (e.g., training machine) gets higher, allowing different angles that were never available before. The base may have holes (e.g., four holes) on framing for a battery box installation. Electrical wiring (e.g., electrical wiring 114 of FIG. 3, two 16 gauge electrical wires) is run from battery box location (e.g., battery 116 of FIG. 3) up to sports ball throwing machine (e.g., connection 118 to sports ball throwing machine 110 of FIG. 3) on the top of the machine upright posts (e.g., machine upright posts 7 of FIG. 3).

In some embodiments, to pivot the lifting bar (e.g., lifting bar 4 of FIG. 3), the SBTML (e.g., SBTML 100 of FIG. 3) may include a lifting device (e.g., an extendable and retractable jack or actuator mechanism) having a clevis (e.g., devises 112A-B of FIG. 3) on top and bottom. The lifting device (e.g., jack or actuator 5 of FIG. 3) may be connected via the top clevis (e.g., clevis 112A of FIG. 3) mounting to the lifting bar (e.g., lifting bar 4 of FIG. 3). The lifting device (e.g., jack or actuator 5 of FIG. 3) may be connected via the bottom clevis (e.g., clevis 112B of FIG. 3) to the upright post (e.g., upright post 3 of FIG. 3).

In some embodiments, the machine upright posts are vertical 2 inch tubing which slides over vertical 1.75 inch inner guide tubing which is welded to the base. The machine upright posts may be configured to slide freely over the inner guide tubing.

In some embodiments, the SBTML has a base having a rectangular shape. In some embodiments, the SBTML has four caster wheels on each corner of the rectangular base. In some embodiments, the SBTML has a support beam from the base to the upright post. In some embodiments, the SBTML has an upright post which connects to a lifting beam. In some embodiments, the SBTML has a lifting beam which connects to a rod, where as the lifting beam raises, the rod raises which lifts the machine upright posts. In some embodiments, the base has two battery beams for placement of a battery.

The SBTML is a lifting machine which allows sports ball throwing machines to work at higher heights. Using a sports ball throwing machine from a higher point allows athletes to practice at many additional different ball angles.

In the figures of the accompanying drawings form a part of the specification and are to be read in conjunction therewith and in which like reference numerals and names may be used to indicate like parts in the various views.

Figure 1:
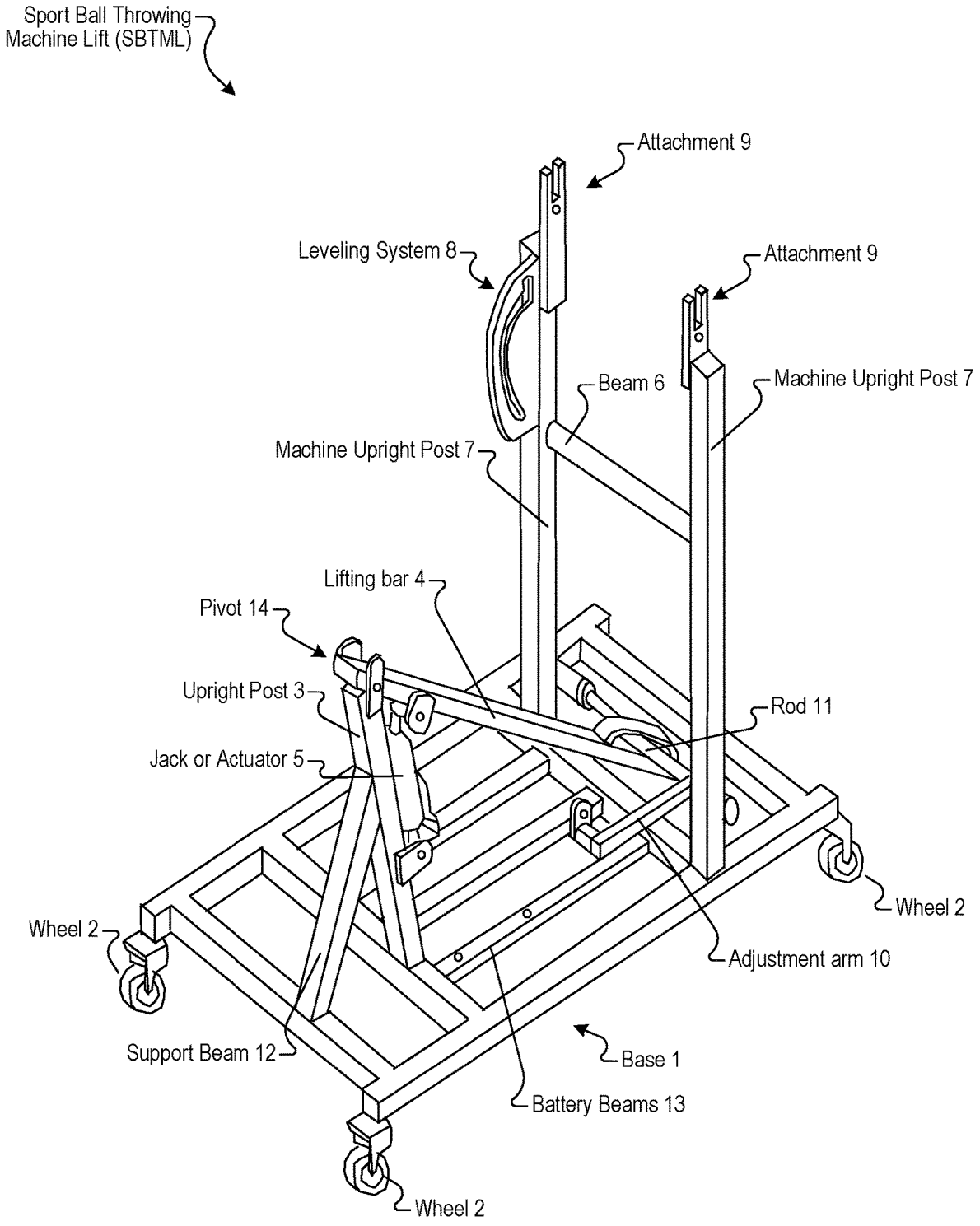
FIG. 1 illustrates a perspective view of a sports ball throwing machine lift (SBTML), according to certain embodiments.
Figure 2:
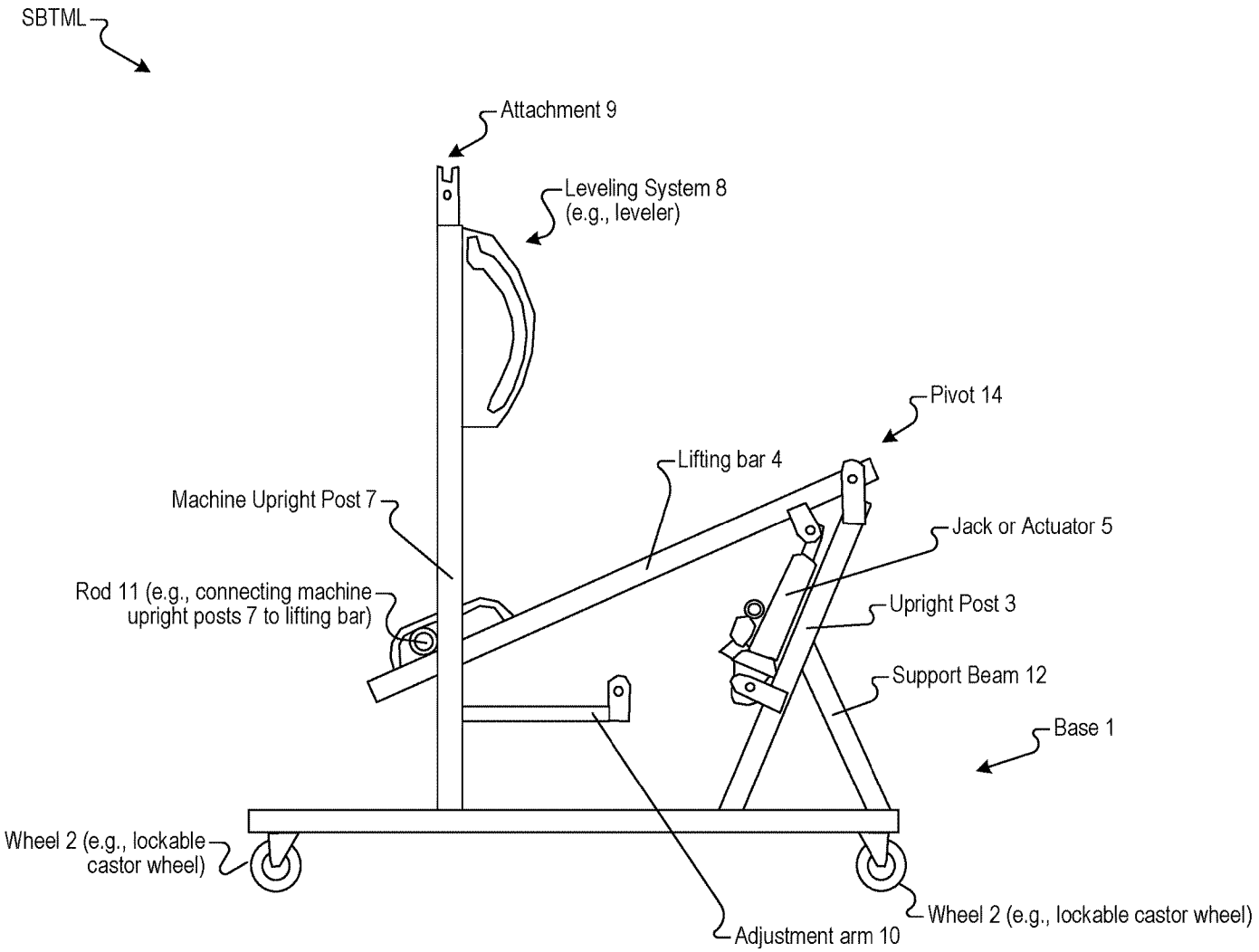
FIG. 2 illustrates a left side view of a SBTML, according to certain embodiments.
Figure 4:
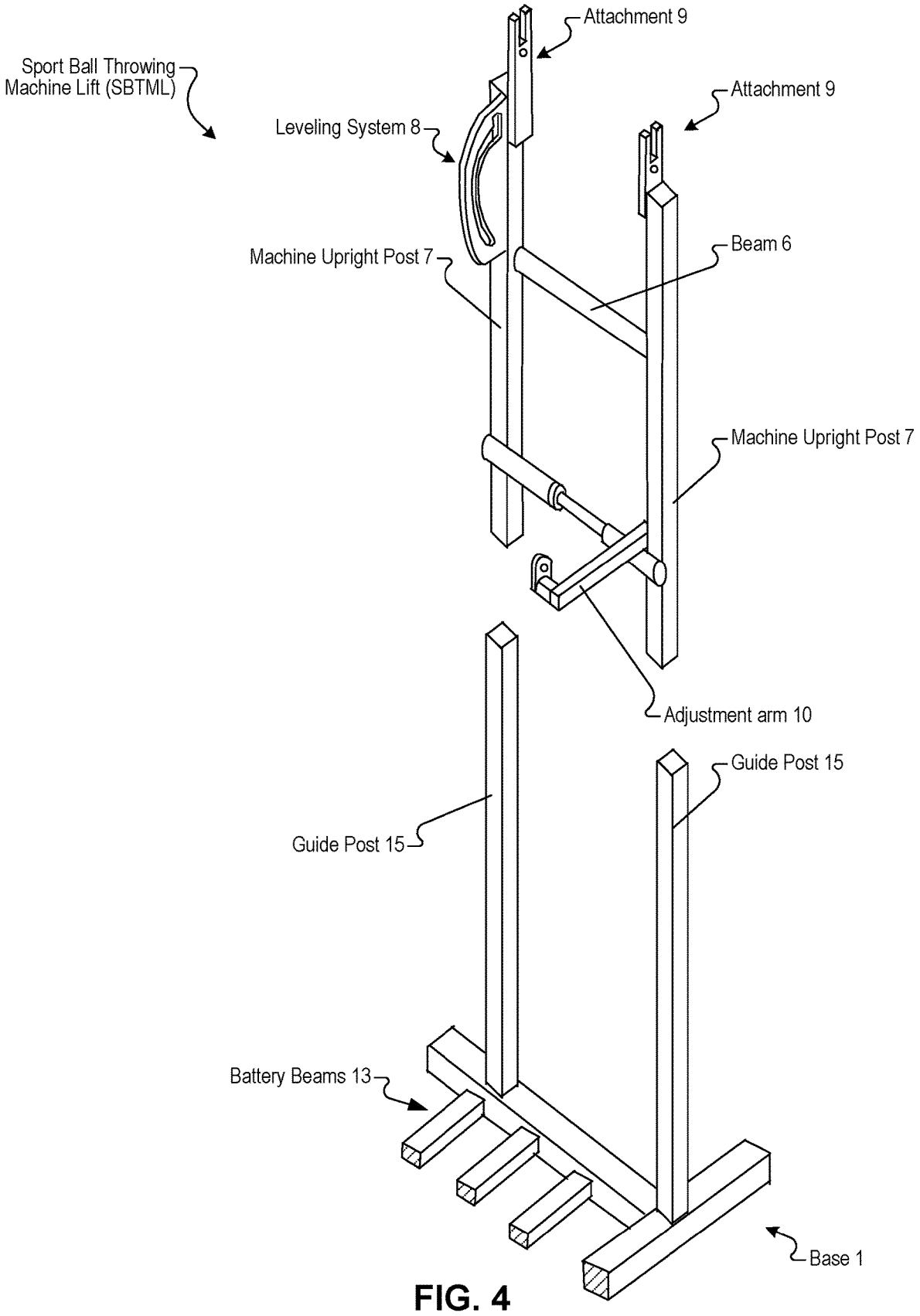
FIG. 4 illustrates a partial exploded view of a SBTML, according to certain embodiments.

In accordance with this present disclosure, a portable SBTML includes a base (e.g., base 1 of FIGS. 1-4) shaped as a rectangle with two support base beams and two battery support beams (e.g., battery beams 13 of FIGS. 1 and 4). Attached beneath base are wheels (e.g., four caster wheels, see wheels 2 of FIGS. 1-3). A pair of inner steel guides (e.g., see guide posts 15 of FIG. 4) are attached vertically to the base. Sliding over the two inner steel guides are the two machine upright posts (e.g., see machine upright posts 7 of FIGS. 1-4). At the top of the two machine upright posts is where the sports ball throwing machine is to be located. A sports ball throwing machine may be bolted to the two machine upright posts.

Referring to FIG. 1, a sport ball throwing machine lift (SBTML) is illustrated as the lifting mechanism for the sports ball throwing machines.

The SBTML may include a base 1. The SBTML may include wheels 2 (e.g., castor wheels) beneath the base 1. In some embodiments, the wheels 2 (e.g., all four castor wheels) can turn freely and all have a locking mechanism. The base 1 may have two vertical inner guide posts 15 (e.g., see FIG. 4). The machine upright posts 7 are configured to slide up and down on the vertical inner guide posts 15 for raising and lowering a sports ball throwing machine. At the top of the upright posts 7 are attachments 9. The attachments 9 are where a sports ball throwing machine connects with the SBTML. A machine upright post 7 (e.g., the further away machine upright post 7 of FIG. 4) may have a leveling system 8, attached to help keep the sports ball throwing machine level. The machine upright post 7 (e.g., the closer machine upright post 7 in FIG. 4, both machine upright posts 7 of FIG. 4) may include an adjustment arm 10. The adjustment arm 10 may connect to a sports ball throwing machine. The adjustment arm 10 may be used for adjusting direction of the throw. Adjustment can be made mechanically or with an actuator. The two machine upright posts 7 are connected together with a beam 6. Beneath the beam 6 is a rod 11 (e.g., connected to both machine upright posts 7) which connects the machine upright posts 7 movement up and down with the lifting bar 4 (e.g., see FIG. 1).

Referring to FIG. 1, the SBTML starts with the base 1. From the base 1 rises two vertical machine upright posts 7 which have inside two smaller inner guide posts 15 (e.g., see FIG. 4). Through a mechanical or actuator expansion of jack or actuator 5, this expansion of jack or actuator 5 raises the lifting bar 4 which makes a connection to the rod 11 which lifts the machine upright posts 7, ultimately lifting the sports ball throwing machine.

What is claimed is:

1. A sports ball throwing machine lift (SBTML) comprising:

a first machine upright post and a second machine upright post that are configured to attach to a sports ball throwing machine;

a rod connected vertically between the first machine upright post and the second machine upright post;

a base;

a plurality of wheels attached to a lower surface of the base;

an upright post that extends up from the base;

a lifting bar that is pivotably connected to an upper portion of the upright post, wherein the lifting bar is further coupled to the rod, wherein responsive to the lifting bar rising, the rod raises the first machine upright post, the second machine upright post, and the sports ball throwing machine; and a lifting device configured to cause the lifting bar to lift the rod, wherein the lifting device comprises a mechanical jack or an electric actuator.

2. The SBTML of claim 1, wherein the SBTML is configured to lift the sports ball throwing machine to at least nine feet above a surface on which the SBTML is disposed.

3. The SBTML of claim 1, wherein the SBTML is configured to lift the sports ball throwing machine to simulate balls being thrown at a user from an elevation corresponding to game situations.

4. The SBTML of claim 1, wherein the plurality of wheels are four locking caster wheels.

5. The SBTML of claim 1, wherein the base comprises framing that forms a plurality of holes, wherein a battery box is attached to the framing via the plurality of holes, and wherein the battery box is electrically coupled to the sports ball throwing machine via electrical wiring.

6. The SBTML of claim 5, wherein the electrical wiring is routed from the battery box to an upper portion of the first machine upright post to connect the battery box to the sports ball throwing machine.

7. The SBTML of claim 1, wherein the lifting device is extendable and retractable, wherein the lifting device comprises an upper clevis disposed on an upper surface of the lifting device and a lower clevis disposed on a lower surface of the lifting device, wherein the lifting device is mounted to the lifting bar via the upper clevis, and wherein the lifting device is connected to the upright post via the lower clevis.

8. The SBTML of claim 1, wherein the first machine upright post and the second machine upright post are vertical 2 inch tubing which each slides over a corresponding vertical inner guide tubing that is 1.75-inch and is welded to the base, wherein the first machine upright post and the second machine upright post are configured to slide over the corresponding vertical inner guide tubing.

9. A sports ball throwing machine lift (SBTML) comprising:

a support structure configured to connect to a sports ball throwing machine, wherein a rod is connected to the support structure;

a base having a rectangular shape, wherein the base has battery beams configured to support a battery;

a plurality of wheels comprising a first wheel attached to a first corner of a lower surface of the base, a second wheel attached to a second corner of the lower surface of the base, a third wheel attached to a third corner of the lower surface of the base, and a fourth wheel attached to a fourth corner of the lower surface of the base;

a lifting beam coupled to the rod, wherein responsive to the lifting beam rising, the rod raises the support structure and the sports ball throwing machine;

an upright post comprising a first distal end connected to the base and a second distal end pivotably connected to the lifting beam; and a support beam comprising a first distal end connected to the base and a second distal end connected to the upright post.

* * * * *